US005464137A

United States Patent [19]

Shirdavani

[11] Patent Number: 5,464,137

[45] Date of Patent: Nov. 7, 1995

[54] GARMENT WEIGHT TRANSFER APPARATUS

[76] Inventor: Hossain A. Shirdavani, 14423 NE. 37th Pl. Apt. G 6, Bellevue, Wash. 98007

[21] Appl. No.: 65,431

[22] Filed: May 24, 1993

[51] Int. Cl.[6] ..... A45P 3/14

[52] U.S. Cl. ..... 224/265; 2/45; 224/272

[58] Field of Search ..... 224/265, 266, 224/272; 2/45

[56] References Cited

U.S. PATENT DOCUMENTS

| | | | |
|---|---|---|---|
| 796,589 | 8/1905 | Maloney | 224/265 |
| 3,030,109 | 4/1962 | Albitz | 224/265 X |
| 3,039,765 | 6/1962 | Tate . | |
| 3,649,921 | 3/1972 | Thomas | 224/265 |
| 4,280,645 | 7/1981 | Goodden | 224/259 |
| 4,438,763 | 3/1984 | Zablen | 224/265 X |
| 4,453,442 | 6/1984 | LaFlame | 224/910 X |
| 5,183,194 | 2/1993 | Shirdavani | 224/224 |

FOREIGN PATENT DOCUMENTS

| | | | |
|---|---|---|---|
| 88345 | 9/1956 | Norway | 224/266 |

*Primary Examiner*—Ernest G. Cusick
*Attorney, Agent, or Firm*—Robert W. Jenny

[57] ABSTRACT

The apparatus relieves the weight of a garment from a wearer's shoulders and transfers the weight to the wearer's midsection, including the hips. The apparatus comprises a belt adjustable to conform to the wearer's waist, an adjustable length upright attached to the belt and supporting shoulder pads at the ends of a beam extending from the upper end of the upright. The upright is adjusted so that the shoulder pads are close to but not touching the wearer's shoulders.

1 Claim, 1 Drawing Sheet

GARMENT WEIGHT TRANSFER APPARATUS

BACKGROUND OF THE INVENTION

1. FIELD

This subject apparatus is in the field of apparatus used to facilitate support of weight by the human body, weight such as that of back packing gear, scuba diving gear and the like. Specifically, it is in the field of such apparatus used to support the weight of heavy garments used by workmen, firefighters and various construction workers. More specifically, it is in the field of weight transfer apparatus used with lead filled garments used to shield the wearer from radiation in various laboratories.

2. PRIOR ART

The prior art in this specific field includes garments containing radiation shielding. U.S. Pat. No. 5,183,194, issued Feb. 2, 1993 to the inventory of the subject invention discloses apparatus for transferring the weight of such garments from the wearer's shoulders to the wearer's hips. Such transference is advantageous because it relieves the wearer's spinal column from the stress and strain of bearing the garment weight and also allows greater freedom of use of the wearer's arms.

Similar but fundamentally different apparatus is shown in U.S. Pat. No. 3,039,765 titled Vest Ceiling Jack. This apparatus comprises a jack fastened to the back of a jacket worn by the user. The pads at the top ends of the jack support ceiling panels (plasterboard) and the forces applied to the panels are transferred to the user's shoulders, not hips.

Further development and use of the '194 apparatus has shown that it would be advantageous to be able to achieve the desired weight transference with simpler, less expensive apparatus.

Accordingly, the primary objective of the subject invention is to provide simple, inexpensive apparatus for holding the weight of a garment off of the shoulders of a person wearing the garment and transferring it to the wearer's midsection, particularly the hips. Other objectives are that the apparatus be comfortable, easy to put on and remove and easily adjustable to conform to the size and shapes of wearers.

SUMMARY OF THE INVENTION

The subject invention is apparatus for transferring the weight of a garment from the wearer's shoulders to the wearer's midsection. The apparatus comprises a stiff, adjustable belt, an adjustable upright member attached to the belt, and shoulder guards attached to a beam attached to the top end of the upright. The upright is adjustable in height to hold the garment close to but not touching the wearer's shoulders, accounting for the variation among wearers of the distances from waists and hips to shoulders. In a preferred embodiment the distance between the pads is also adjustable. The upright may be detachably attached to the belt.

In use the belt is fastened comfortably around the user's waist so that it essentially rests on the user's hips. The upright is adjusted so that the pads are close to but not touching the wearer's shoulders. The garment can then be donned with the shoulder guards of the apparatus supporting the garment by the pads.

The invention is described in more detail below with reference to the attached drawings.

DETAILED DESCRIPTION OF THE INVENTION

Figure 1:
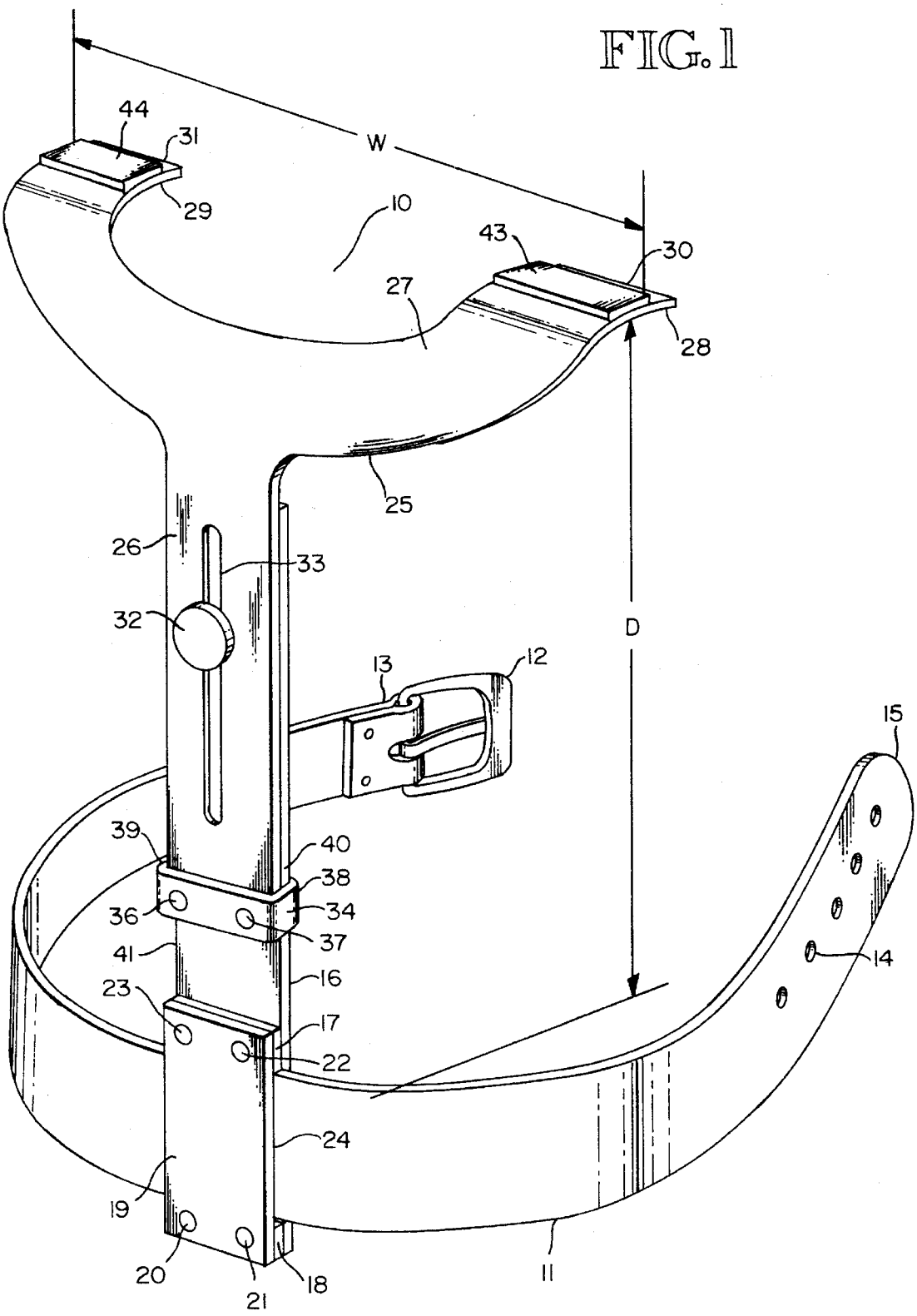
FIG. 1 is a perspective view of the subject apparatus.

The subject invention is apparatus for transferring the weight of a garment from a wearer's shoulders to the wearer's midsection, including the hips. As shown in FIG. 1, the apparatus 10 comprises a belt 11 having a buckle 12 at one end 13 and a plurality of holes, hole 14 being typical, spaced along the belt from end 15. Upright assembly 16 comprises spacers 17 and 18 and cover plate 19 assembled by fasteners 20, 21, 22 and 23 to form a passage 24 through which the belt is passed so that the upright is oriented vertically in use and is slidably supported on the belt and can be moved along it to allow positioning the upright at the center of the user's back. Bracket assembly 25 is T-shaped and has a stem portion 26, a beam portion 27 and garment support portions 28 and 29 at ends 30 and 31 of the beam portion respectively. The stem portion is attached to the upright assembly by knobbed fastener 32 passing through slot 33 in the stem portion. Clip 34, attached to end 35 of the stem portion by fasteners 36 and 37, has tabs 38 and 39 which engage sides 40 and 41 of the upright to stabilize the bracket assembly rotationally on the upright. The distance D of the garment support portions from the belt can be adjusted by loosening the knobbed fastener, moving the bracket assembly along the upright assembly and retightening the fastener. Similar arrangements could be incorporated into the beam portion of the bracket assembly, one on each side, if desired to enable adjustment of the width W of the assembly. Pads 43 and 44 are attached to the garment support portions to reduce wear and tear on garments supported on the subject apparatus, if desired.

The simplicity and effectiveness of the subject apparatus are made possible by the structural stiffness of the belt. To provide the necessary stiffness the belt has a width W, which is at its maximum over the portion of its length possibly engaged with the upright and is in the range of 1½ to 3 inches with 2½ inches preferred and the belt material has the stiffness of leather, as rated in the trade, in the range of 4 ounces to 10 ounces with 7 ounces to 9 ounces preferred.

In use the belt is fastened snugly but not tightly around the user's waist and in contact with the user's hips and the upright is centered relative to the user's back. The garment support portions extend over the user's shoulders and the proximity of those portions to the shoulders is adjusted by adjusting the position of the bracket on the upright.

It is considered to be understandable from this description that the subject invention meets its objectives. It provides apparatus for holding the weight of a garment off the wearer's shoulders and transferring the weight to the wearer's midsection. The apparatus is comfortable, easy to put on and remove and is easily adjustable to conform to the sizes and shapes of wearers.

It is also considered to be understood that while one embodiment of the invention is described herein, other embodiments and modifications of the one described are possible within the scope of the invention which is limited only by the attached claims.

I claim:

1. Garment weight transfer apparatus for use by a user having a waist, hips, shoulders and a back having a center, said apparatus comprising an upright member oriented vertically in use and having a lower end, a T-shaped bracket comprising a stem portion, a beam portion having first and second beam portion ends, a first garment support portion at said first beam portion end and a second garment support portion at said second beam portion end, a belt having a maximum width and a length and made from material having the stiffness of leather rated in the range of 4 ounces to 10 ounces, said width being in the range of 1.5 to 3 inches, said belt further comprising means for fastening said belt about said waist, means for slidably attaching said lower end of said upright member to said belt with said upright member essentially vertical to said length of said belt, means for adjustably attaching said stem portion of said bracket to said upright member such that said garment support portions are a distance from said belt and said distance is adjustable, whereby with said belt fastened about said waist and in contact with said hips said garment support portions are above said shoulders and the proximity of said garment support portion to said shoulders can be adjusted by said means for adjustably attaching said stem portion to said upright and said stem portion can be positioned at said center of said back using said means for slidably attaching said lower end of said upright to said belt.

* * * * *